United States Patent [19]

Ishikawa et al.

[11] 3,953,263

[45] Apr. 27, 1976

[54] PROCESS FOR PREVENTING THE FORMATION OF NITROGEN MONOXIDE IN TREATMENT OF METALS WITH NITRIC ACID OR MIXED ACID

[75] Inventors: Misao Ishikawa, Chosei; Rokuro Tsuji, Chiba; Norihisa Yoshimori, Mobara, all of Japan

[73] Assignee: Hitachi, Ltd., Japan

[22] Filed: Nov. 26, 1973

[21] Appl. No.: 418,907

[52] U.S. Cl. ..... 156/7; 134/3; 134/41; 156/18; 156/20; 252/79.2

[51] Int. Cl.[2] ..... C23F 1/00; C23F 1/02

[58] Field of Search ..... 134/3, 41; 29/423; 156/18, 20; 75/97; 252/79.1, 79.2

[56] References Cited

UNITED STATES PATENTS

| | | | |
|---|---|---|---|
| 2,762,728 | 9/1956 | Hahn | 134/3 |
| 2,965,521 | 12/1960 | Bomberger et al. | 134/3 |
| 2,978,301 | 4/1961 | Margulies et al. | 156/18 X |
| 3,094,489 | 6/1963 | Barnes | 252/79.2 |
| 3,293,093 | 12/1966 | Jones et al. | 156/18 |
| 3,373,113 | 3/1968 | Achenbach | 252/79.2 |
| 3,463,733 | 8/1969 | Achenbach | 252/79.4 |
| 3,476,624 | 11/1969 | Hogya et al. | 252/79.1 X |
| 3,556,883 | 1/1971 | Naito et al. | 156/20 |

*Primary Examiner*—William A. Powell
*Attorney, Agent, or Firm*—Craig & Antonelli

[57] ABSTRACT

The formation of nitrogen monoxide in treatment of metals with nitric acid or a mixed acid can be prevented by adding at least one of ammonium peroxodisulfate and hydrogen peroxide to nitric acid or a mixed acid consisting mainly of nitric acid and sulfuric acid.

5 Claims, 1 Drawing Figure

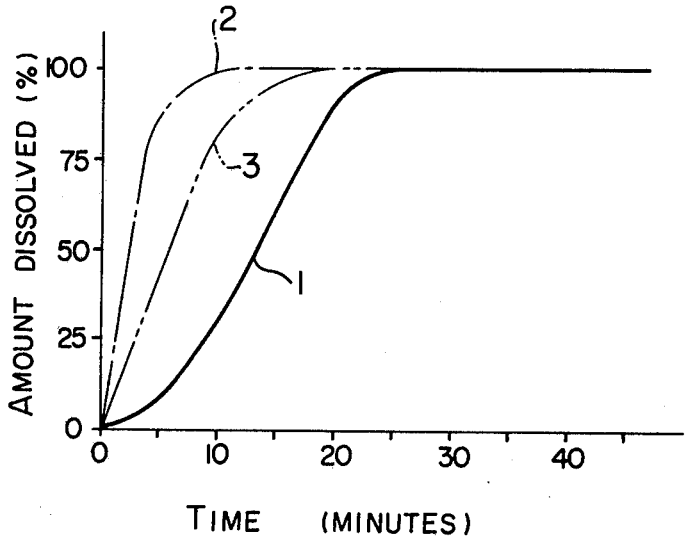
2
3
1
AMOUNT DISSOLVED (%)
100
75
50
25
0
0
10
20
30
40
TIME (MINUTES)

PROCESS FOR PREVENTING THE FORMATION OF NITROGEN MONOXIDE IN TREATMENT OF METALS WITH NITRIC ACID OR MIXED ACID

The present invention relates to a process for preventing the formation of nitrogen monoxide in treatment of metals with nitric acid or a mixed acid. More particularly, the invention relates to a process for preventing the formation of nitrogen monoxide in the dissolution of molybdenum with nitric acid or mixed acid when, for example, a tungsten coil for vacuum tubes, etc. is produced by winding a tungsten wire round a molybdenum wire and then dissolving off the molybdenum wire. Further, the invention relates to a process for preventing the formation of nitrogen monoxide in the pickling or chemical polishing of copper, iron or steel such as, for example, the removal of scale, as a pretreatment for copper-plating, with nitric acid or a mixed acid.

A coil heater used in electronic tubes such as cathode-ray tubes or vacuum tubes has heretofore been produced by winding a tungsten wire as a heater wire round a molybdenum wire as a core at a predetermined pitch to produce a spiral wire, cutting and shaping the spiral wire into a predetermined size and shape, applying an alumina insulator onto the surface of the spiral wire, sintering the applied alumina insulator, and finally dissolving off the unnecessary molybdenum coil only by acid-treatment. If the alumina coating is omitted in the above-mentioned process, a coil filament used for electric lamps, fluorescent lamps, vacuum tubes, etc. can be obtained.

For the acid-treatment of the molybdenum wire, a mixture of nitric acid and sulfuric acid such as a mixture of 17*l* of 67% $HNO_3$ and 7.5*l* of 98% $H_2SO_4$ may generally be used. A coil heater obtained by winding a tungsten wire round a molybdenum core is thrown into this mixed acid and the mixed acid is then heated to dissolve the molybdenum wire only. According to this method, colorless NO gas generated by the reaction of the formula, $$Mo + 2HNO_3 + 3H_2SO_4 \rightarrow Mo(SO_4)_3 + 4H_2O + 2NO \quad (1)$$

with the dissolution of molybdenum is released in the air and is oxidized on contact with air into $NO_2$ and $N_2O_4$ and turns brown.

On the one hand, for Example, in the pickling of copper, 10 – 30% by volume mixed acid consisting of 10 – 30% by volume sulfuric acid and 50% by volume nitric acid is used for intense scale. If nitric acid or a mixed acid is used as the treating agent, colorless NO gas is generated with the dissolution of copper according to the reaction of the formula, $$3Cu + 8HNO_3 \rightarrow 3Cu(NO_3)_2 + 4H_2O + 2NO \quad (2)$$

and is released in the air and oxidized on contact with air into $NO_2$ and $N_2O_4$, turning brown. These gaseous nitrogen oxides are harmful gases and do harm to working environment and cause environmental pollution. Therefore, this operation is carried out in a draft chamber and the gaseous nitrogen oxides are led to the outside of the chamber by suction by the use of a powerful exhanst apparatus, so that the gaseous nitrogen oxides may not enter the workshop, and are washed with water or an aqueous alkali solution to remove them by absorption. Thus, a large equipment and a great expense are required for the complete removal of nitrogen oxides.

The present invention has solved the above mentioned problem and provides a process for preventing the formation of nitrogen monoxide in treatment of metals with nitric acid or a mixed acid.

As a result of various studies for solving the above-mentioned problem, the present inventors have now found that metals can be treated without generating harmful nitrogen oxides when an oxidizing agent is added to a treating agent consisting of nitric acid or a mixed acid consisting mainly of nitric acid and sulfuric acid which have heretofore been used in general. It is considered to be owing to the fact that the oxidizing agent converts nitrogen oxides such as NO into oxides, which are easy to dissolve, such as $NO_2$ or $NO_3^-$ in the liquid. Thus, NO generated by the reaction of the above-mentioned formulas (1) or (2) is converted by the oxidizing agent into $NO_2$ as follows:

$$2NO + O_2 \rightarrow 2NO_2 \quad (3)$$

The $NO_2$ is immediately dissolved in water as follows:

$$3NO_2 + H_2O \rightarrow 2HNO_3 + NO \quad (4)$$

NO produced by the reaction of the formula (4) is again oxidized and absorbed by water according to the reactions of the formulas (3) and (4).

As the above-mentioned oxidizing agent, permanganates, perchlorates, peroxides, peroxo acid salts, etc. are considered, but the present inventors have found, as a result of various experiments on these oxidizing agents, that it is most suitable for accomplishing the object of the invention to use ammonium peroxodisulfate or hydrogen peroxide as an oxidizing agent.

The following examples illustrate the present invention by referring to the accompanying drawing showing a dissolution rate curve of molybdenum in a mixed acid.

EXAMPLE 1

Into a corrosion liquid consisting of a mixture of 43g of ammonium peroxodisulfate and 200cc of a mixed acid obtained by mixing 17*l* of 67% $HNO_3$ with 7.5*l* of 98% $H_2SO_4$, 1000 coil heaters (the weight of molybdenum 6.1g) obtained by winding a tungsten wire round a molybdenum core were thrown. The molybdenum wire was completely dissolved in about 10 – 15 minutes without the generation of gaseous nitrogen oxides. In the accompanying drawing, curve 3 is a dissolution rate curve of molybdenum in this case. For comparison, a dissolution rate curve of molybdenum when a prior art corrosion liquid consisting only of the same mixed acid as in the example was used under heating and a dissolution rate curve of molybdenum when the oxidizing agent in the example was replaced by 12g of potassium permanganate are shown by curves 1 and 2 in the drawing, respectively.

As is clear from the accompanying drawing, the dissolution rate increases in the order of the corrosion liquid consisting only of the mixed acid, the ammonium peroxodisulfate-containing corrosion liquid and the potassium permanganate-containing corrosion liquid. Thus, the addition of an oxidizing agent increases the dissolution rate. It is also owing to the fact that the addition of an oxidizing agent causes the generation of heat and thereby heating as required in prior art corrosion liquids becomes unnecessary. The dissolution rate is thus increased at least by the time for heating the mixed acid. Also, it is owing to a difference in heat of dilution and to a lower dilution temperature that the ammonium peroxodisulfate-containing corrosion liquid is inferior to the potassium permanganate-containing corrosion liquid in dissolution rate.

In the case of the addition of potassium permanganate, however, manganese compounds precipitate if an amount of potassium permanganate is large. Thus, when a metallic coil is coated with alumina as in the afore-mentioned coil heater, the manganese compounds remain in the alumina and the dielectric strength of the heater is deteriorated. Therefore, the manganese compounds should be completely removed. Thereby, although potassium permanganate-containing corrosion liquid can satisfy requirements in the dissolution of a molybdenum core when a tungsten filament coil for some vacuum tubes without alumina coating, electric lamps, fluorescent lamps, etc. is produced, in the case of a coil heater with alumina coating, a step of removing manganese compounds is required and it is not easy to remove the manganese compounds completely. The potassium permanganate-containing corrosion liquid is not advisable from viewpoints of the quality of the product and working hours.

For similar reasons, it is necessary to avoid the use of an oxidizing agent consisting of a metal salt or an oxidizing agent which releases a harmful gas.

On the other hand, ammonium peroxodisulfate-containing corrosion liquid does not form precipitates even at a large amount added since the ammonium peroxodisulfate is a compound of sulfuric acid and ammonium. Therefore, no substance remains in the alumina coating layer of a coil heater and thereby the quality of the product is high, washing after the dissolution is simple, and working hours can be reduced. Further, the ammonium peroxodisulfate-containing corrosion liquid is advantageous in that an equipment for treating a waste liquor containing precipitated manganese compounds is not required in contrast with potassium permanganate-containing corrosion liquid. Of course, the ammonium peroxodisulfate-containing corrosion liquid is also applicable to a coil filament without alumina coating.

The effectiveness of ammonium peroxodisulfate as an oxidizing agent is owing to the fact that oxygen is formed according to the reaction formula, $$2(NH_4)_2S_2O_8 + 4H_2O \xrightarrow{\text{Warming}} 4NH_4HSO_4 + 2H_2O + O_2 \quad (5)$$

when an aqueous solution of ammonium peroxodisulfate is warmed and this $O_2$ oxides NO. Further, the ammonium peroxodisulfate does not contain such a metal element as forms precipitates. It is clear from the above description that hydrogen peroxide is also effective as an oxidizing agent since hydrogen peroxide may be decomposed into $O_2$.

EXAMPLE 2

About 5g of a copper wire of 4mm diameter was thrown into a treating agent consisting of 50cc of 67% nitric acid and 5g of ammonium peroxodisulfate and the removal of scale was carried out for about one minute. Thus, scale was thoroughly removed without observing the generation of brown gaseous nitrogen oxides.

EXAMPLE 3

5 Grams of a copper wire of 4mm diameter was thrown into a treating agent consisting of 60cc of 98% sulfuric acid, 20cc of 67% nitric acid, 5cc of 35% hydrochloric acid and 5g of ammonium peroxodisulfate and the chemical polishing of the copper wire was carried out for about one minute. Thus, satisfactory luster was obtained without observing the generation of gaseous nitrogen oxides.

An amount of the gaseous nitrogen oxides released in the air (measured at the exhaust port, an amount of the exhaust gas 100 $m^3$/min) was found to be about 0.25 ppm in the Examples 2 and 3. This value was about 1/250 of that in the prior art process without ammonium peroxodisulfate (about 70 ppm). The liquid after the treatments was clear and free of precipitate, and thereby the treatment of the waste liquid was easy.

The reaction formula in Example 2 is considered based on the above-mentioned formulas (2), (3), (4) and (5) to be as follows:

$$6Cu + 16HNO_3 + 6(NH_4)_2S_2O_8 + 12H_2O \rightarrow 6Cu(NO_3)_2 + 12NH_4HSO_4 + 4HNO_3 + 12H_2O \quad (6)$$

Therefore, in the treatment of copper, ammonium peroxodisulfate may be used in a 1 : 1 molar ratio with regard to copper to be dissolved. Also, when ammonium peroxodisulfate is added to nitric acid or a mixed acid for the pickling or chemical polishing of metals, the composition of the treating agent, the treatment temperature and the treatment time may be determined according to the metal to be treated and the object.

What is claimed is:

1. In a process for dissolving a molybdenum core from a coil heater by dipping said coil heater in a resolving solution containing nitric acid and water as main components, said coil heater being prepared by winding tungsten wire around said molybdenum core, applying an alumina insulator onto the tungsten wire and sintering the applied alumina insulator, the improvement comprising adding sufficient ammonium peroxodisulfate to said resolving solution so that the formation of nitrogen monoxide during dissolution of the molybdenum core is prevented.

2. The process of claim 1, wherein said resolving solution contains sulfuric acid.

3. The process of claim 1, wherein said resolving solution consists essentially of water, nitric acid and ammonium peroxodisulfate.

4. The process of claim 1, wherein said resolving solution is an aqueous solution containing about 17 parts by volume of 67% $HNO_3$ and 7.5 parts by volume of 98% $H_2SO_4$.

5. The process of claim 4, wherein said resolving solution contains about 43 grams of ammonium peroxodisulfate for each 200 cc of the mixed acid obtained by mixing 17 parts by volume of 67% $HNO_3$ and 7.5 parts by volume of a 98% $H_2SO_4$.

* * * * *